US005191746A

United States Patent [19]

Russell

[11] Patent Number: 5,191,746

[45] Date of Patent: Mar. 9, 1993

[54] WINDOW SILL EXTENSION APPARATUS

[76] Inventor: Robert J. Russell, 2368 Randolph St., Huntingdon Valley, Pa. 19006

[21] Appl. No.: 771,111

[22] Filed: Oct. 4, 1991

[51] Int. Cl.[5] ..... E06B 1/00; A01G 9/00

[52] U.S. Cl. ..... 52/97; 48/345.1; 47/68; 47/79; 47/39

[58] Field of Search ..... 248/345.1; 47/39, 40, 47/68, 79; 52/97, 716, 718

[56] References Cited

U.S. PATENT DOCUMENTS

| | | | |
|---|---|---|---|
| 1,460,486 | 7/1923 | Harvey | 47/79 |
| 1,878,850 | 9/1932 | Hilgers | 248/345.1 |
| 2,782,562 | 2/1957 | Watkins | 47/79 |
| 3,150,854 | 3/1963 | Jamieson | 248/345.1 |

FOREIGN PATENT DOCUMENTS

| | | | |
|---|---|---|---|
| 3925112 | 2/1991 | Fed. Rep. of Germany | 47/68 |
| 8910271 | 7/1989 | France | 47/68 |
| 0195602 | 2/1938 | Switzerland | 47/68 |

*Primary Examiner*—David A. Scherbel

*Assistant Examiner*—Wynn E. Wood

*Attorney, Agent, or Firm*—Leon Gilden

[57] ABSTRACT

A "U" shaped unitary bracket is arranged for mounting about a forward edge of a window sill utilizing an adhesive strip mounted to a bottom surface of a first plate extending beyond an underlying parallel second plate. Connector fasteners are orthogonally directed through the second plate for securement to a bottom surface of the window sill. A modification of the invention includes a window box structure mounted to a connecting web of the first and second plates, with the window box including a rear wall mounting a plurality of sockets in a parallel relationship relative to the second plate utilizing threaded extender rods arranged for projection and in engagement with a rearwardly oriented vertical wall surface to align the window sill box relative to the associated window. A further modification of the invention includes an irrigation conduit structure positioned in an adjustable relationship overlying the window box for the continuous directing of irrigation fluid into the window box structure.

6 Claims, 4 Drawing Sheets

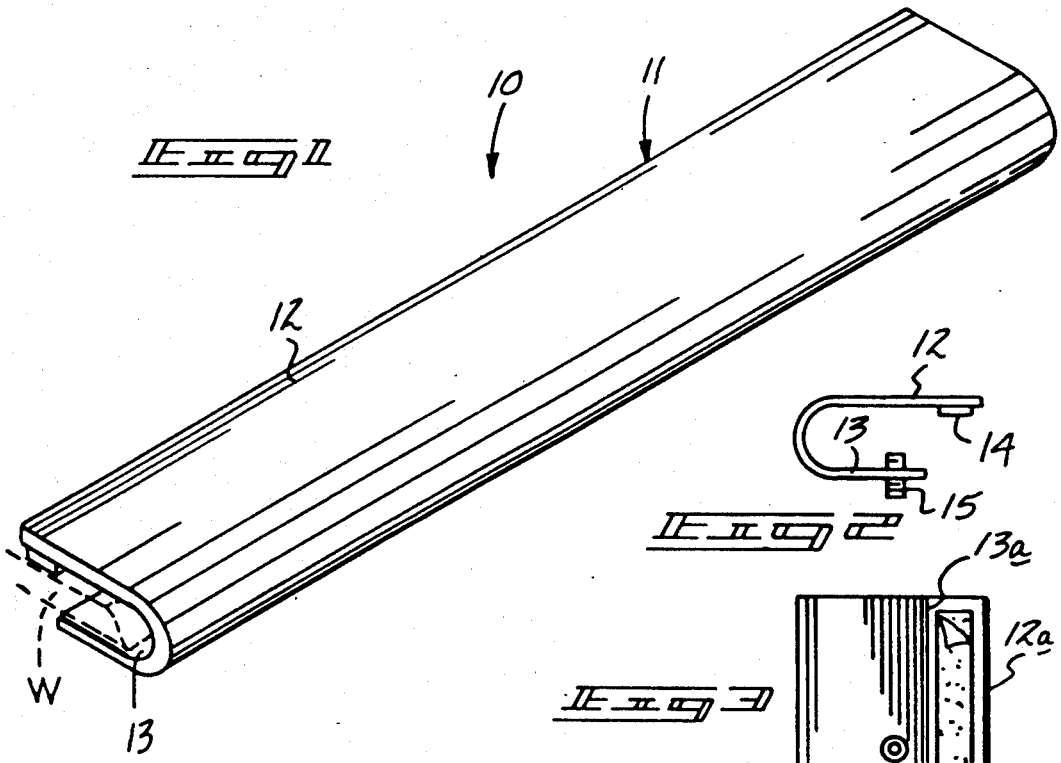
Fig 1
Fig 2
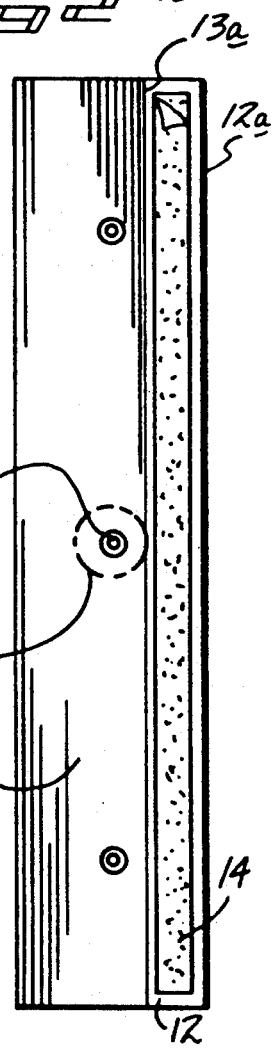
Fig 3
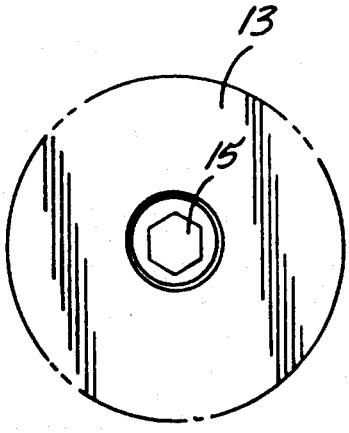
Fig 4

WINDOW SILL EXTENSION APPARATUS

BACKGROUND OF THE INVENTION

1. Field of the Invention

The field of invention relates to window apparatus, and more particularly pertains to a new and improved window sill extension apparatus wherein the same is arranged to extend usable space relative to a window sill.

2. Description of the Prior Art

A window sill and projecting flanges of that type provide limited supporting surface to accommodate various items such as plant pots and the like. Prior art structure to provide for window sill extension surface is illustrated in U.S. Pat. No. 4,793,114 to Pacca wherein a "C" shaped channel is defined between biased plates deflected towards one another to secure a window sill therebetween. Shortcomings of the Pacca patent limit accommodation of window sills of various thicknesses as opposed to the instant invention permitting fixed securement of a variety of window sill structure arranged for reception within a top and bottom plate structure of the instant invention.

U.S. Pat. No. 4,869,451 to Gordon sets forth a plate member mounted to a triangulated bracket construction that is secured to a vertical wall surface oriented below the window sill structure.

U.S. Pat. No. 3,949,880 to Fortunato sets forth a shelf extender wherein a generally "C" shaped clamp is arranged to receive threaded locking rods directed through a bottom plate member into a bottom surface of the clamp structure.

As such, it may be appreciated that there continues to be a need for a new and improved window sill extension apparatus as set forth by the instant invention which addresses both the problems of ease of use as well as effectiveness in construction in providing a window sill and accessory organization and in this respect, the present invention substantially fulfills this need.

SUMMARY OF THE INVENTION

In view of the foregoing disadvantages inherent in the known types of window sill bracket structure now present in the prior art, the present invention provides a window sill extension apparatus wherein the same is arranged to provide for an extended available shelf surface relative to an associated window sill structure. As such, the general purpose of the present invention, which will be described subsequently in greater detail, is to provide a new and improved window sill extension apparatus which has all the advantages of the prior art window sill apparatus and none of the disadvantages.

To attain this, the present invention provides a "U" shaped unitary bracket arranged for mounting about a forward edge of a window sill utilizing an adhesive strip mounted to a bottom surface of a first plate extending beyond an underlying parallel second plate. Connector fasteners are orthogonally directed through the second plate for securement to a bottom surface of the window sill. A modification of the invention includes a window box structure mounted to a connecting web of the first and second plates, with the window box including a rear wall mounting a plurality of sockets in a parallel relationship relative to the second plate utilizing threaded extender rods arranged for projection and in engagement with a rearwardly oriented vertical wall surface to align the window sill box relative to the associated window. A further modification of the invention includes an irrigation conduit structure positioned in an adjustable relationship overlying the window box for the continuous directing of irrigation fluid into the window box structure.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved window sill extension apparatus which has all the advantages of the prior art window sill apparatus and none of the disadvantages.

It is another object of the present invention to provide a new and improved window sill extension apparatus which may be easily and efficiently manufactured and marketed.

It is a further object of the present invention to provide a new and improved window sill extension apparatus which is of a durable and reliable construction.

An even further object of the present invention is to provide a new and improved window sill extension apparatus which is susceptible of a low cost of manufacture with regard to both materials and labor, and which accordingly is then susceptible of low prices of sale to the consuming public, thereby making such window sill extension apparatus economically available to the buying public.

Still yet another object of the present invention is to provide a new and improved window sill extension apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of the instant invention.

FIG. 2 is an orthographic side view of the instant invention.

FIG. 3 is an orthographic bottom view of the instant invention.

FIG. 4 is an orthographic view of Section 4 as set forth in FIG. 3.

DESCRIPTION OF THE PREFERRED EMBODIMENT

Figure 5:
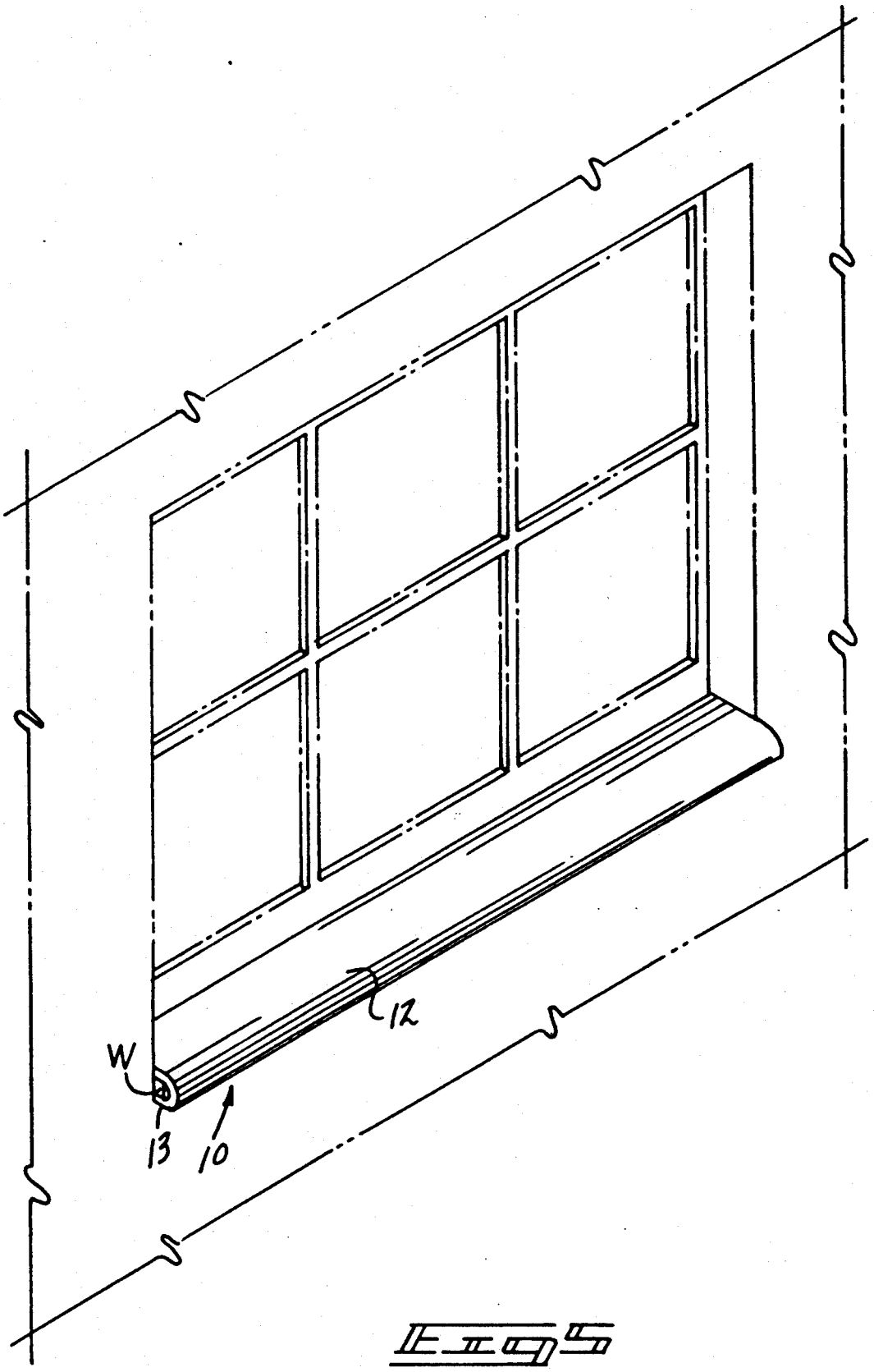
FIG. 5 is an isometric illustration of the instant invention in use.

With reference now to the drawings, and in particular to FIGS. 1 to 10 thereof, a new and improved window sill extension apparatus embodying the principles and concepts of the present invention and generally designated by the reference numerals 10 and 10*a* will be described.

More specifically, the window sill extension apparatus 10 of the instant invention essentially comprises a "U" shaped unitary bracket 11, including a first plate 12 spaced from and parallel a second plate 13. The first plate 12 is defined by a first width, wherein the second plate is defined by a second width and the second width is arranged less than the first width. The first plate 12 defines a first edge and the second plate defines a second edge 12*a* and 13*a* respectively, wherein the first edge 12*a* is arranged parallel to and spaced from the second edge 13*a* projecting beyond the first edge, wherein an adhesive strip 14 mounted coextensively to a bottom surface of the first plate 12 positioned adjacent the first edge 12*a* is arranged for securement to a top surface of the window sill "W", with the adhesive strip 14 projecting beyond the second edge 13*a*. The first and second plates 12 and 13 are secured together by a bracket central web 11*a*. A plurality of threaded locking rods 15 are threadedly and orthogonally directed through the second plate 13 in confrontation with the first plate 12 to secure and clamp the window sill "W" between the locking rods 15 and the bottom surface of the first plate 12.

Figure 6:
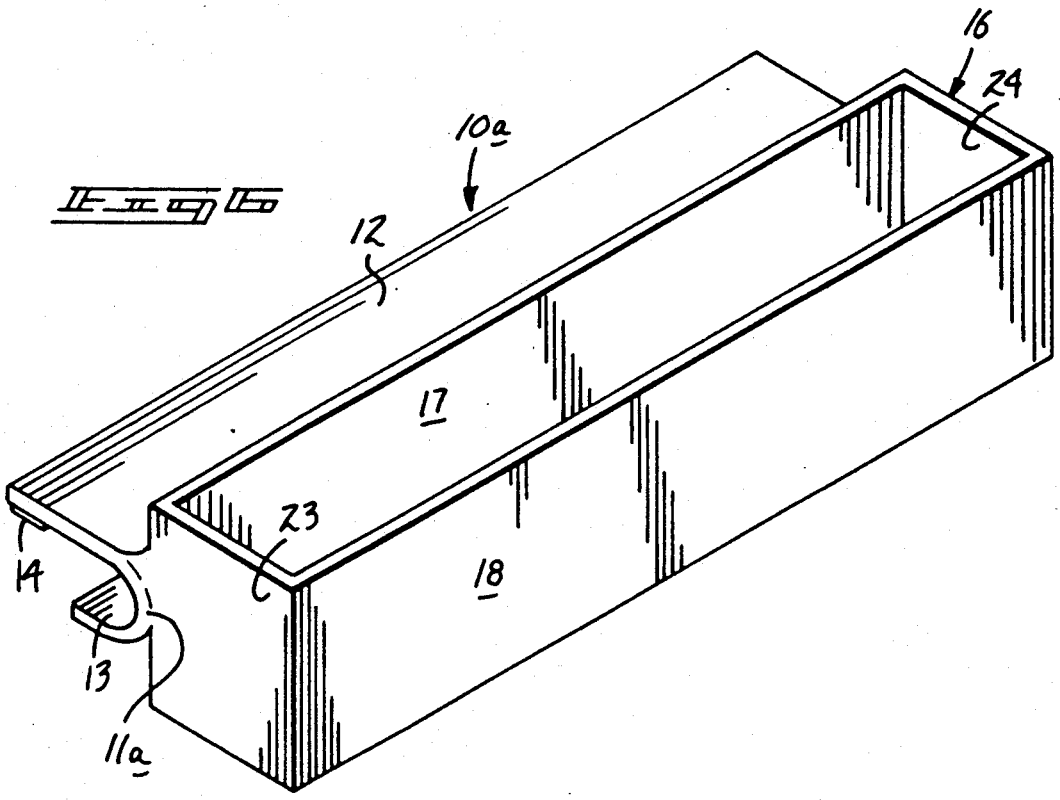
FIG. 6 is an isometric illustration of a modification of the invention.
Figure 7:
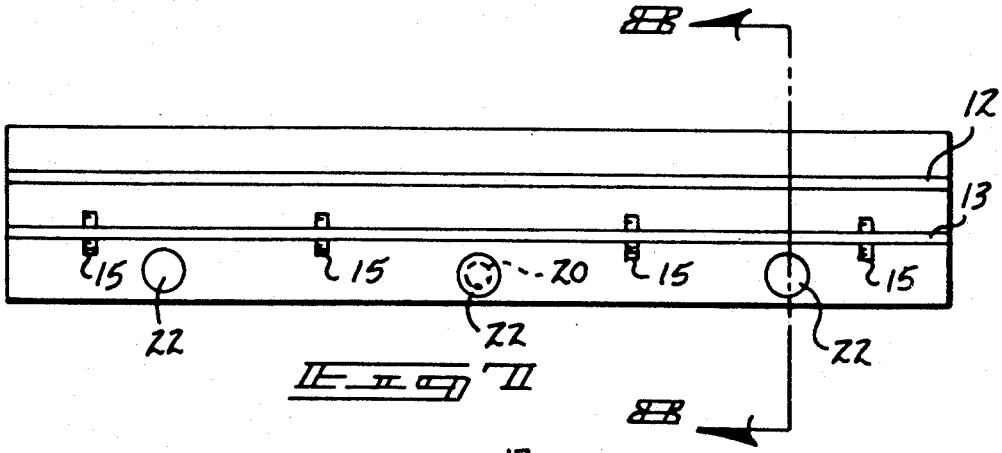
FIG. 7 is an orthographic rear view of the modification of the invention, as set forth in FIG. 6.
Figure 8:
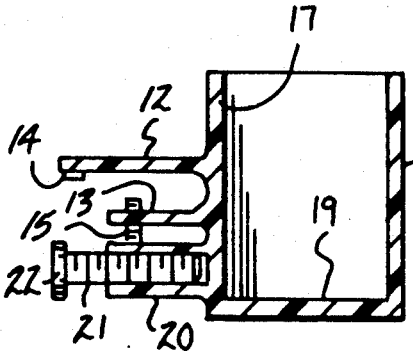
FIG. 8 is an orthographic view, taken along the lines 8—8 of FIG. 7 in the direction indicated by the arrows.

Reference to the FIG. 6 illustrates a modified apparatus 10*a*, wherein a window box 16 is fixedly mounted to the bracket central web 11*a*, with the window box 16 including a rear wall 17 spaced from a front wall 18, with the rear and front walls arranged in a parallel relationship and orthogonally oriented relative to a floor 19. The rear wall 17 is orthogonally oriented relative to the first and second plates 12 and 13. The window box 11*a* is also defined by respective right and left side walls 23 and 24 respectively. Orthogonally mounted to the rear wall 17 and projecting below and in a parallel relationship relative to the second plate 13 are a plurality of internally threaded sockets 20 each including a generally threaded alignment rod 21 projecting beyond the socket, with each alignment rod 21 including a rod head 22 that is arranged for contiguous communication with a vertical wall surface positioned below the window sill structure "W" to provide for alignment of the window box 16 in use.

Figure 9:
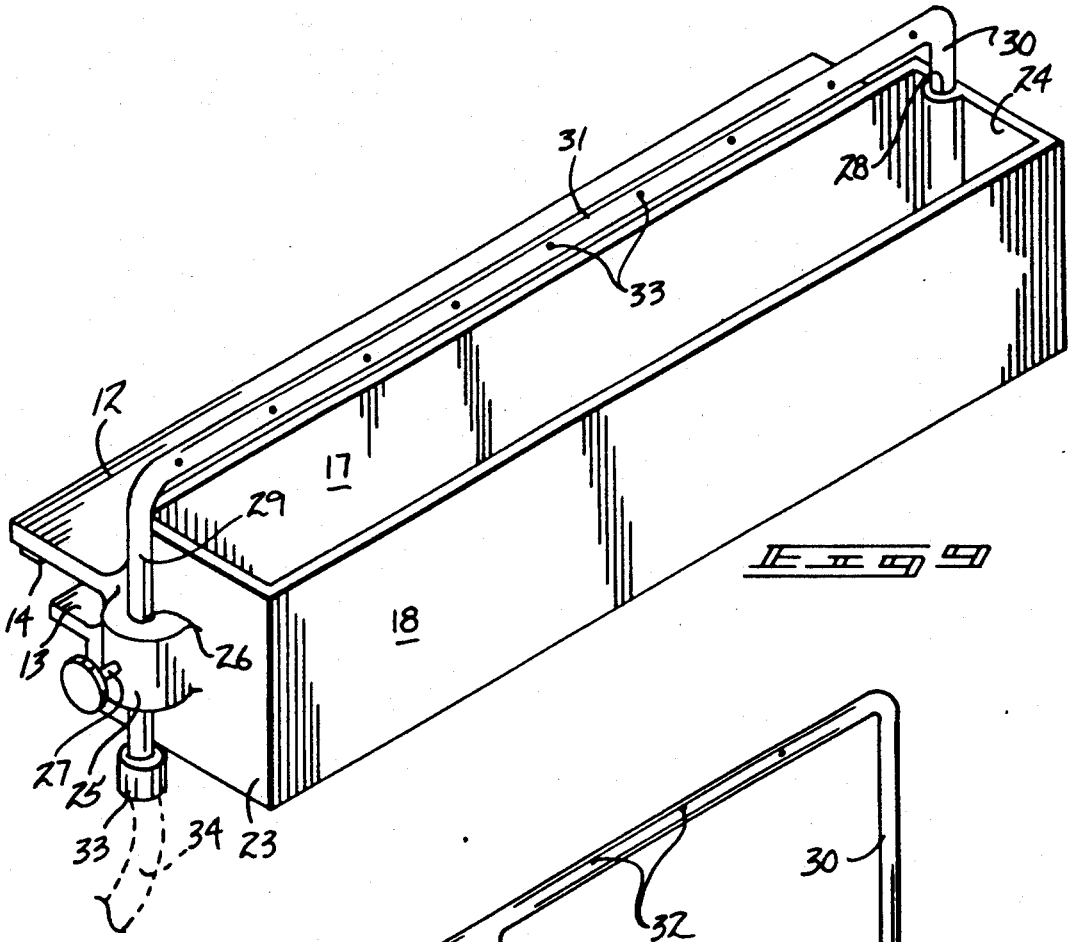
FIG. 9 is an isometric illustration of a further modification of the invention.

The apparatus as illustrated in FIG. 9 includes respective right and left side walls, including a respective right and left mounting boss 25 and receiving socket 28. The mounting boss 25 mounted to the right side wall 23 includes a boss bore 26 slidably receiving an irrigation conduit right leg, with the left wall receiving socket 28 slidably receiving an irrigation conduit left leg 30 and an irrigation conduit central leg 31 positioned above and parallel relative to the floor 19, including a plurality of spaced apertures 32 therethrough. The irrigation conduit's right and left legs 29 and 30 permit a spatial spacing of the central conduit leg 31 above the window box 16 to provide positioning of the apertures 32 to adjust an area of spray relative to the apertures to underlying plants that may be positioned within the box structure 16. A lock rod 27 orthogonally directed into the mounting boss 25 intersects the bore 26 to fixedly and vertically adjust the irrigation conduit central leg 31. A fluid hose coupling 33 is mounted to a lower terminal end of the conduit right leg 29 for securement of a fluid hose 34 therethrough to direct a water irrigation fluid into the conduit structure as illustrated.

Figure 10:
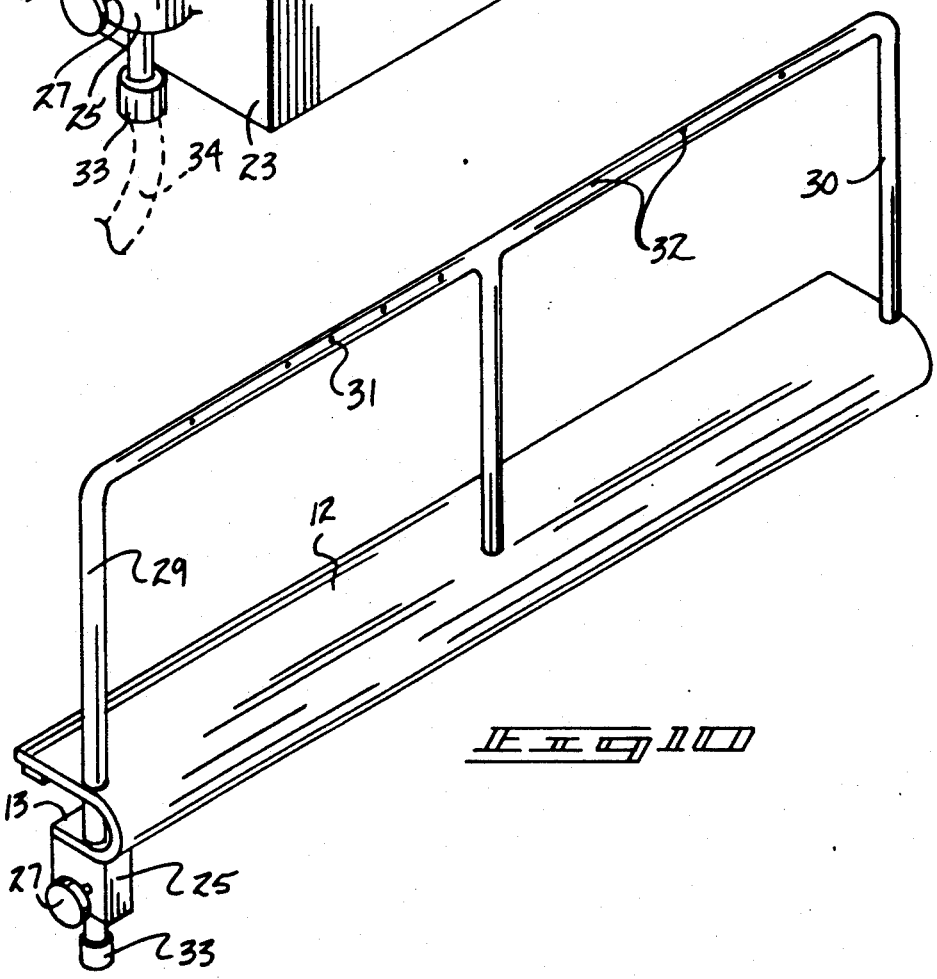
FIG. 10 is an isometric illustration of the irrigation system utilized as a trellis structure in association with the "U" shaped bracket organization.

The FIG. 10 illustrates the irrigation conduit structure arranged relative to the "U" shaped bracket for use as a trellis relative to a climbing plant relative to the bracket structure.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A window sill extension apparatus, comprising, a "U" shaped unitary bracket, the bracket including a first plate arranged parallel to and coextensive with a second plate, wherein said first and second plates are joined together by a bracket central web having a window box fixedly mounted to said central web, wherein the first plate is defined by a first width and the second plate defined by a second width, the first width substantially greater than the second width, and the first plate defined by a first edge and the second plate defined by a second edge, the first edge and second edge arranged in a parallel spaced coextensive relationship relative to one another, with the first edge extending beyond the second edge wherein said apparatus further includes a plurality of threaded locking rods threadedly and orthogonally directed through said second plate in confrontation with a bottom surface of said first plate, and an adhesive strip mounted to a bottom surface of the first plate adjacent the first edge, wherein the adhesive strip extends beyond the second edge.

2. The window box of claim 1 including a rear wall fixedly mounted to the bracket central web and orthogonally oriented relative to the first plate and the second plate, a front wall spaced from the rear wall coextensive therewith, and the rear wall and the front wall mounted to a floor, and the window box further including a right side wall spaced from a left side wall.

3. An apparatus as set forth in claim 2 including a plurality of internally threaded sockets orthogonally mounted to the rear wall extending below and parallel to the second plate, and each threaded socket including an externally threaded alignment rod threadedly and adjustably mounted within each socket for projection beyond each socket to permit engagement with a vertical surface below an associated window sill.

4. An apparatus as set forth in claim 3 wherein the right side wall includes a right wall mounting boss having a mounting boss bore, and the left side wall includes a left wall receiving socket, and an irrigation conduit right leg slidably directed through the mounting boss bore and the irrigation conduit including an irrigation conduit central leg positioned above and parallel to the floor, and an irrigation conduit left leg arranged parallel to the right leg orthogonally oriented relative to the central conduit, and the right leg received within the left wall receiving socket, and the irrigation conduit central leg including a plurality of spaced apertures directed therethrough to direct fluid through the apertures into the window box.

5. An apparatus as set forth in claim 4 including a lock rod directed through the right wall mounting boss intersecting the mounting boss bore for engagement with the irrigation conduit right leg to effect locking of the right leg relative to the right wall mounting boss bore.

6. An apparatus as set forth in claim 5 including a fluid hose coupling mounted to a lower terminal end of the irrigation conduit right leg, and a fluid hose arranged for selective securement to the fluid hose coupling.

* * * * *